US010049531B2

(12) United States Patent
Triolo

(10) Patent No.: US 10,049,531 B2
(45) Date of Patent: Aug. 14, 2018

(54) WAGERING GAME

(71) Applicant: Giuseppe Triolo, Toronto (CA)

(72) Inventor: Giuseppe Triolo, Toronto (CA)

( * ) Notice: Subject to any disclaimer, the term of this patent is extended or adjusted under 35 U.S.C. 154(b) by 76 days.

(21) Appl. No.: 14/995,745

(22) Filed: Jan. 14, 2016

(65) Prior Publication Data

US 2016/0225234 A1 Aug. 4, 2016

Related U.S. Application Data

(60) Provisional application No. 62/103,253, filed on Jan. 14, 2015.

(51) Int. Cl.

| | |
|---|---|
| ***G06F 17/00*** | (2006.01) |
| ***G07F 17/32*** | (2006.01) |
| ***A63F 1/00*** | (2006.01) |
| ***A63F 3/00*** | (2006.01) |

(52) U.S. Cl.

CPC ..... *G07F 17/3293* (2013.01); *A63F 1/00* (2013.01); *A63F 3/00157* (2013.01); *G07F 17/322* (2013.01)

(58) Field of Classification Search

USPC ..... 463/11–13; 273/292, 293, 303

See application file for complete search history.

(56) References Cited

U.S. PATENT DOCUMENTS

| | | | | |
|---|---|---|---|---|
| 5,288,091 | A | 2/1994 | Breeding | |
| 8,590,898 | B2 | 11/2013 | Buza | |
| 2002/0190467 | A1* | 12/2002 | Braun | A63F 3/00157 273/274 |
| 2007/0066378 | A1* | 3/2007 | White | A63F 1/18 463/13 |
| 2011/0124398 | A1* | 5/2011 | Templeman | G07F 17/32 463/22 |
| 2015/0221180 | A1* | 8/2015 | Araico | G07F 17/326 463/11 |
| 2016/0063798 | A1* | 3/2016 | Rehill | G07F 17/3204 463/22 |
| 2016/0171812 | A1* | 6/2016 | Dinkla | G07F 17/322 463/13 |

* cited by examiner

*Primary Examiner* — Ronald Laneau
(74) *Attorney, Agent, or Firm* — Manelli Selter PLLC; Edward J. Stemberger

(57) ABSTRACT

A system and method for playing a wagering game among a plurality of players using a set of playing cards having a plurality of suits with an equal number of cards per suit. Players are provided an opportunity to wager and then cards are dealt from the set and placed face up on a gaming grid in a manner to compare the number of cards dealt in each suit until a final set number of cards in any one of the plurality of suits have been dealt. Each player's wagers are then settled based on the respective location of cards dealt from the set.

12 Claims, 2 Drawing Sheets

WAGERING GAME

FIELD

Figure 1:
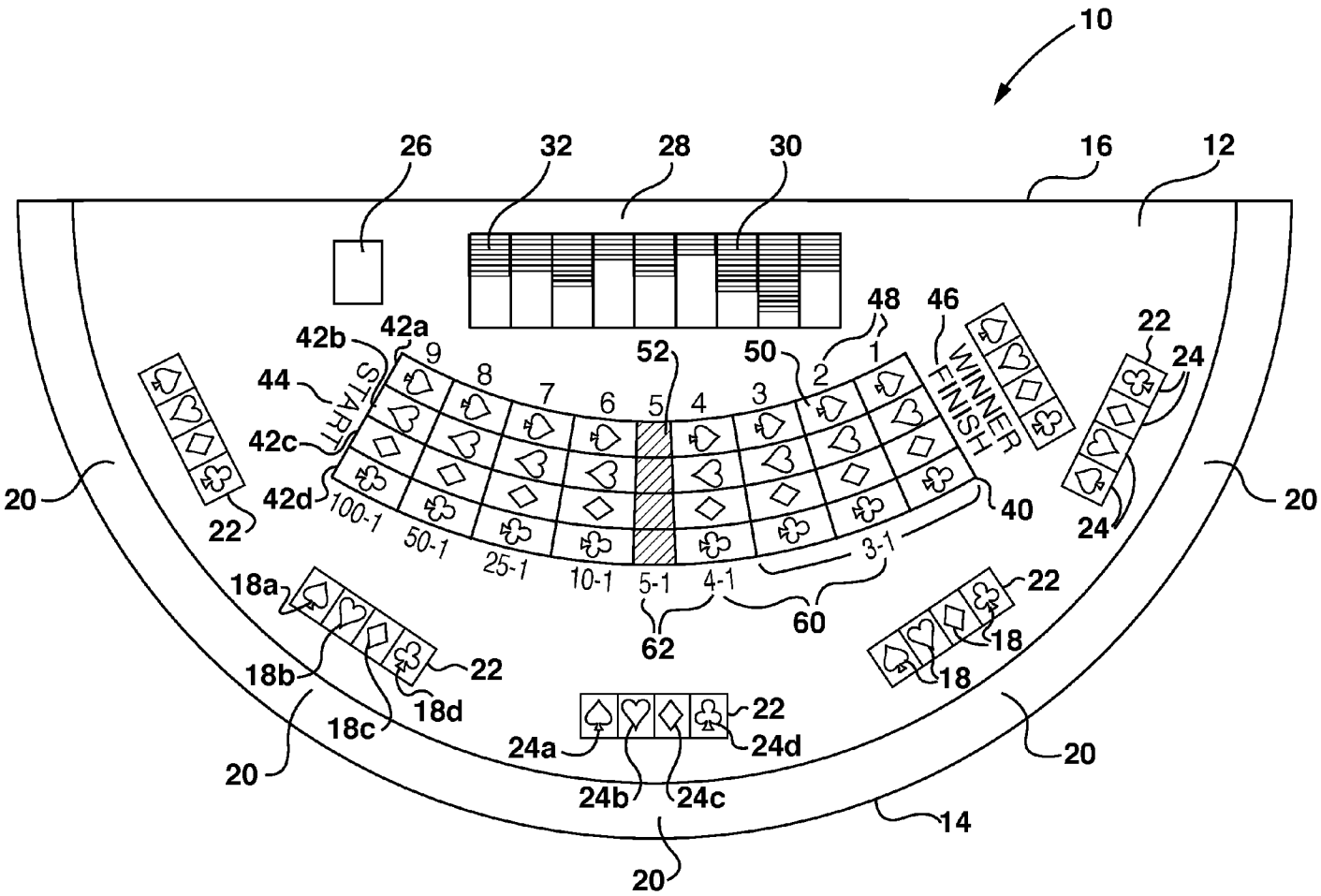

This specification relates to wagering games and in particular to methods and systems for playing wagering games that are based on a set of playing cards.

BACKGROUND

The following background discussion is not an admission that anything discussed below is citable as prior art or common general knowledge. The documents listed below are incorporated herein in their entirety by this reference to them.

There are a wide variety of wagering games that may be played in a wide variety of formats. Formats include the casino environment where games may be played at gaming tables or on gaming machines. Formats outside of the casino environment include online gaming, over the counter games (such as "scratch-and-win" games) and recreational games played at home or private gatherings.

Casinos desire wagering games that are accessible to a broad selection of players in order to encourage as many people as possible to participate in the game at the casino. The games preferably should be easy to understand and fun to play in a group environment. The games preferably are also quick to play while providing multiple wagering opportunities in order to provide players with a sense of participation and control over the player's wins or losses. Casinos also of course require that the games provide an optimum return for the casino and meet local regulatory requirements.

Wagering games that are based on a set of playing cards can often be intimidating for new players. Games such as poker and blackjack for example require, or at least are perceived to require, an intimate knowledge of the rules and the associated odds of winning. Part of the intimidation of such games is that players feel the need to track the permutations and combinations associated with different hands of face cards and/or numbered cards.

There is an ongoing desire for a wagering game that is accessible to a broad range of players in a format that suits the casino environment. It is further desirable that such a wagering game may adapted for other formats that further open the accessibility of the game to a broad range of players.

SUMMARY

In one aspect the invention provides a method of playing a wagering game among a plurality of players using a set of playing cards having a plurality of suits with an equal number of cards per suit, the method comprising the steps of:

each player placing a wager on at least one of said plurality of suits;

dealing cards from said set and placing face up in a manner to compare the number of cards dealt in each suit;

suspend dealing cards once an intermediate set number of cards in any one of said plurality of suits have been dealt;

giving each player an option to modify their wager;

continue dealing cards from said set and placing face up in a manner to compare the number of cards dealt in each suit until a final set number of cards in any one of said plurality of suits have been dealt; and settling each players wagers based on the respective location of cards dealt from said set.

In another aspect the invention provides a system for playing a wagering game among a plurality of players using a set of playing cards having a plurality of suits with an equal number of cards per suit, the system comprising:

a game grid comprising a plurality of columns and a plurality of rows, said plurality of columns corresponding to the plurality of suits and said plurality of rows being equal to or less than the number of playing cards divided by the number of suits;

at least one wagering grid having a plurality of cells corresponding to said plurality of suits; and at least one decision zone defined by one of said rows in said game grid.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. For simplicity and clarity of illustration, where considered appropriate, reference numerals may be repeated among the drawings to indicate corresponding or analogous elements.

Figure 2:
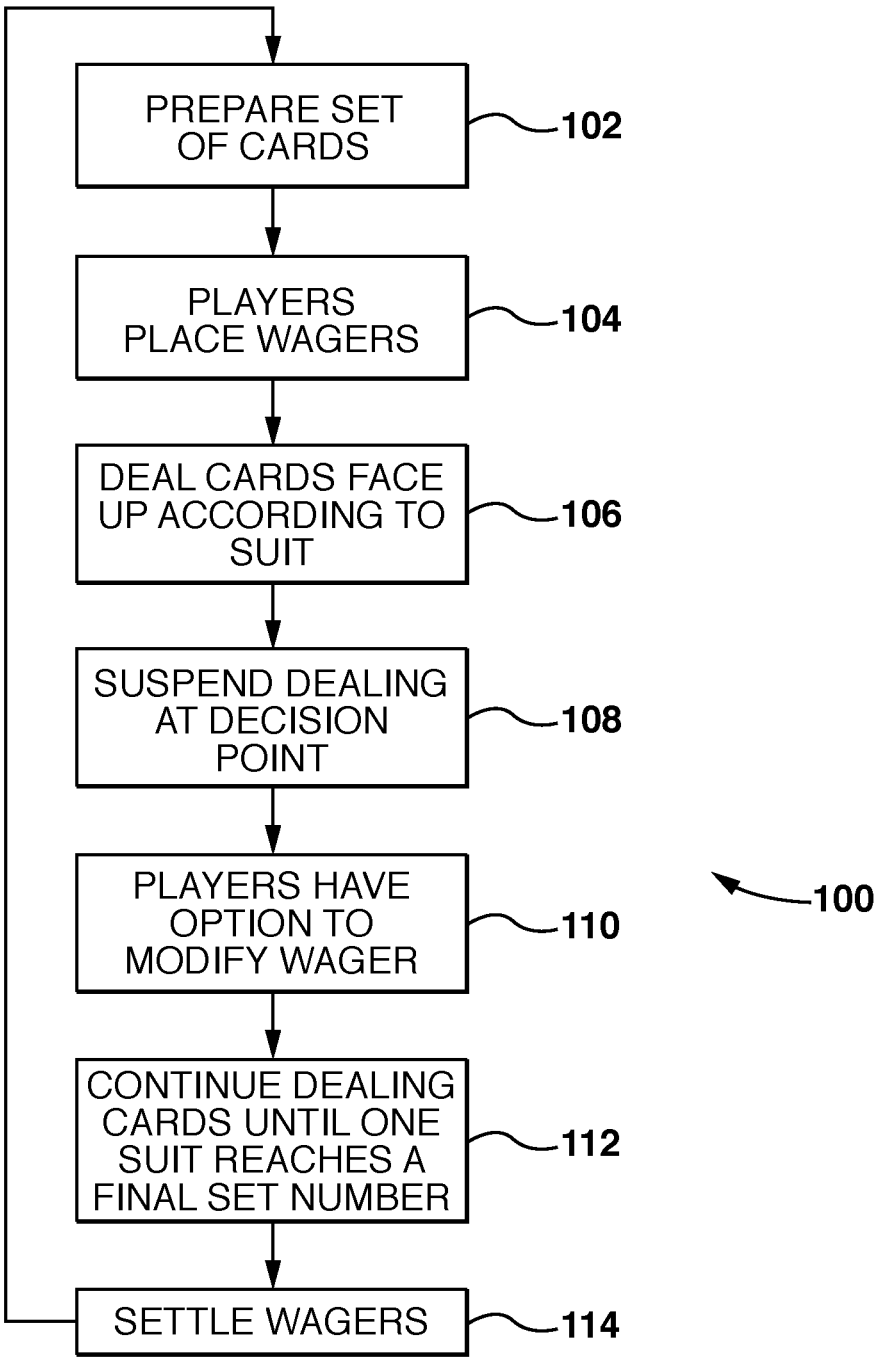

FIG. 1 is a plan view of a system for playing a wagering game in accordance with an embodiment of the present invention; and FIG. 2 is a flow diagram of a method of playing a wagering game in accordance with an embodiment of the present invention.

DESCRIPTION OF VARIOUS EMBODIMENTS

Various apparatuses or methods will be described below to provide examples of the claimed invention. The claimed invention is not limited to apparatuses or methods having all of the features of any one apparatus or method described below or to features common to multiple or all of the apparatuses described below. The claimed invention may reside in a combination or sub-combination of the apparatus elements or method steps described below. It is possible that an apparatus or method described below is not an example of the claimed invention. The applicant(s), inventor(s) and/or owner(s) reserve all rights in any invention disclosed in an apparatus or method described below that is not claimed in this document and do not abandon, disclaim or dedicate to the public any such invention by its disclosure in this document.

A system for playing a wagering game in accordance with an embodiment of the present invention is shown generally at 10 in FIG. 1.

System 10 is adapted for use by an operator (such as a casino) to enable players to play the game at a gaming table in a casino environment but is not intended to be restricted to such format. System 10 may for example be modified with one or more physical elements being replaced with one or more virtual or computer generated elements. Such adaptations may be utilized by an operator to enable players to play the game for example on gaming machines in a casino environment or formats outside of the casino environment including online gaming, over the counter games (such as "scratch-and-win" games) and recreational games played at home or private gatherings.

System 10 includes a gaming surface 12 having a first side 14 that is adapted for accommodating a plurality of players and a second side 16 that is adapted for accommodating a dealer.

Players occupy individual player locations 20 with individual wagering grids 22 disposed at each location 20. Each wagering grid 22 includes a plurality of cells 24 corresponding to each suit 18 of a set of playing cards 26. Thus, for a standard set of playing cards 26, wagering grid 22 includes four cells 24*a-d* corresponding to the four suits 18*a-d* (hearts, diamonds, clubs and spades). A "standard set" of playing cards 26 as used herein means fifty two cards comprising four suits with thirteen cards per suit. The "standard set" of playing cards 26 may further include at least one joker (typically two are provided) that are not intended to be used with a preferred embodiment of the game but optionally may be utilized with a variation of the game as described further below.

Wagering grid 22 may have additional cells adapted for other wagering options such as the colour of the winning suit (for example red or black for a standard set of playing cards 26), the rank of the winning suit (for example face card or number card) or other variables.

Dealer 18 is disposed at a dealer location 28 having a tray 30 for holding chips 32 of different values for use by the players in wagering. It will be understood that chips 32 are preferably physical units for a gaming table format of the game however may have virtual or electronic representation that are better suited for other formats of the game.

A game grid 40 is disposed on gaming surface 12 between players and dealer. Game grid 40 comprises a plurality of columns 42 extending from a starting point 44 to a finishing point 46 for conducting a "race" between the different suits 18 of playing cards 26. Each column 42 corresponds to a different suit 18 for playing cards 26. Thus, for a standard set of playing cards 26, there are four columns 42*a-d* corresponding to the four suits 18*a-d*.

Game grid 40 further includes a plurality of rows 48 that, together with columns 42, define individual cells 50 each sized for receiving a single playing card 26. The plurality of rows is equal to or less than the number of playing cards 26 divided by the number of suits 18. Thus, for a standard set of playing cards 26 as many as thirteen rows 48 may be provided. However a fewer number of rows 48 are preferred and nine rows 48 are most preferred. Each row 48 thus defines a checkpoint or length between finishing point 46 and starting point 44.

A decision zone 52 is defined in at least one row 48 to provide players with an opportunity to make a wagering decision as described further below. In one embodiment, a single decision zone 52 is provided preferably at a location that is equidistant from starting point 44 and finishing point 46 (at the fifth row 48 if nine rows 48 are provided). In another embodiment, two or more decision zones 52 may be provided preferably at equal intervals between starting point 44 and finishing point 46.

Gaming surface 12 further includes payout indicia 60 adjacent to game grid 40 to identify the payout 62 provided on a player's wager based on the location of playing cards 26 that have been placed on grid 40 by dealer upon completion of the game.

Payouts 62 are determined based on the calculated odds of different events occurring and the amount that the casino or house wish to retain from the total amounts wagered. For example, in the embodiment depicted in FIG. 1 for a game played with a standard deck of playing cards 26, payout indicia 60 identify the following payouts 62 based on the number of rows 48 or "lengths" between the suit that first reaches the finishing point 46 and the suit that is next closest to the finishing point 46:

| Rows 48 from finishing point 46 | Payout 62 |
|---|---|
| 3 or fewer | 3-1 |
| 4 | 4-1 |
| 5 | 5-1 |
| 6 | 10-1 |
| 7 | 25-1 |
| 8 | 50-1 |
| 9 | 100-1 |

Referring to FIG. 2, a method for playing a wagering game in accordance with an embodiment of the present invention is shown generally at 100. Method 100 is adapted for use by an operator (such as a casino) to enable players to play the game at a gaming table in a casino environment but is not adapted to be restricted to such a format. Method 100 may for example be modified for use with virtual or computer generated elements. Such adaptations may be utilized by an operator to enable players to play the game on gaming machines in a casino environment or formats outside of the casino environment including online gaming, over the counter games (such as "scratch-and-win" games) and recreational games played at home or private gatherings.

Method 100 begins with step 102 of preparing or shuffling a set of playing cards 26. This may be done manually by dealer or with the use of a shuffling machine (not shown) or electronically in the case of a game played using virtual or computer generated elements. In a preferred embodiment, for a standard set of playing cards 26, jokers are removed prior to shuffling.

Method 100 then proceeds to step 104 where players place wagers of one or more chips 32 on one or more cells 24*a-d* of wagering grid 22 corresponding to one or more suits 18*a-d* of playing cards 26 or other wagering options presented by wagering grid 22. In one embodiment, players are permitted to place a wager on only one of cells 24*a-d*. In a preferred embodiment, players 16 are permitted to place wagers on multiple cells 24*a-d*. For example, a player 16 may wager one or more chips 32 on cell 24*b* corresponding to the suit of hearts 18*b* as well as wager one or more chips 32 on cell 24*d* corresponding to the suit of clubs 18*d*. The player 16 will only receive a payout 62 based on the wager placed on the suit that first reaches the finishing point 46 (if neither of the chosen suits reaches the finishing point then both wagers are lost).

Method 100 then proceeds to step 106 where dealer deals playing cards 26 from the top of the set and places them face up one-by-one into cells 50 on a column 42 on game grid 40 that corresponds to the suit 18 of each respective playing card 26. The first card 26 in a suit 18 is placed into a cell 50 in a corresponding column 42 that is located in the first row 48 from starting point 44. The next card 26 of the same suit 18 is placed into a cell 50 in the second row 48 from starting point 44 and so on until a playing card 26 is placed in a row 48 defining a decision zone 52.

Thus, for a standard set of playing cards 26, if the first card 26 is a heart then the dealer places that card in the cell 50 in the first row 48 in column 42 that corresponds to hearts. If the second card is also a heart then the dealer places that card in the cell 50 in the second row 48 in column 42 that corresponds to hearts. If the next card is a club then dealer places the card in the cell 50 in the first row 48 in column 42 that corresponds to clubs. Dealer continues to deal cards 26 and place them into corresponding cells 50 until a card 26 is dealt into a cell 50 disposed in decision zone 52 (in the fifth row 42 for the embodiment depicted in FIG. 1).

When a card 26 has been placed into a decision zone 52, method 100 then proceeds to step 108 where players are invited to decide among a plurality of options 110 to modify their wagers. Options 110 include: (i) abandoning the original wager and receiving a refund (up to a permitted limit—for example 50% of the original amount), (ii) increasing the original wager (up to a permitted limit—for example no more than double the original amount), (iii) placing a new wager on a different suit (up to a permitted amount—for example no more than the amount of the original wager) or (iv) taking no action and continuing with the original wager.

Method 100 then proceeds to step 112 where dealer continues to deal cards 26 and place them into corresponding cells 50 until a card is dealt into a cell 50 in the final row 48 at finishing point 46 thus determining the winning column 42 and corresponding winning suit 18.

Method 100 then proceeds to step 114 where dealer settles the wagers based on the outcome of the game. The payout 62 is determined by the number of rows 48 between the winning suit 18*a-d* and column 42 and the next leading suit 18*a-d* and column 42 as indicated by payout indicia 60.

Method 100 then returns to step 102 for the commencement of a new game.

There are a number of variations that may be made to the system 10 and method 100 described above. These include having multiple decision zones 52 thus providing multiple opportunities to modify wagers. Also, wagering grid 22 may be modified to include additional cells 24 adapted for selecting additional wagering options (such as the colour or rank of the winning suit). Another variation is to include jokers in the playing cards 26 that impact the play of the game. Jokers may for example act to advance the preceding dealt card 26 by one or more rows 48. Jokers may alternatively impact the subsequently dealt card or may act to retreat a preceding or subsequently dealt card by one or more rows.

Other variations may be made to the format of the game. Rather than a table top format as shown in FIG. 1, system 10 and method 100 may be provided in a gaming machine format similar to a slot machine or in an online format similar to a video game. System 10 and method 100 may also be provided in a ticket format with scratch and win panels or the like. System 10 and method 100 may also be provided in a game board format suitable for play at home or other private location.

While the above description provides examples of one or more processes or apparatuses, it will be appreciated that other processes or apparatuses may be within the scope of the accompanying claims.

I claim:

1. A method of operating a wagering game to be played among a plurality of players using a set of playing cards having a plurality of suits with an equal number of cards per suit, the method comprising the steps of:

providing a gaming surface configured to receive at least some of the playing cards thereon, the gaming surface including a game grid thereon comprising indicia defining a plurality of columns and a plurality of rows, said plurality of columns corresponding to the plurality of suits and said plurality of rows being equal to or less than the number of playing cards per suit, said plurality of columns extending from a starting point to a finishing point for conducting a "race" between said plurality of suits of said playing cards; allowing each player to place a wager on at least one of said plurality of suits;

allowing each player to place a wager on at least one of said plurality of suits;

dealing cards from said set face up onto a column of the game grid that corresponds to the suit of a respective card in a manner to compare the number of cards dealt in each suit;

suspend dealing cards once an intermediate set number of cards in any one of said plurality of suits have been dealt;

giving each player an option to modify their wager;

continue dealing cards from said set face up onto a column of the game grid that corresponds to the suit of a respective card in a manner to compare the number of cards dealt in each suit until a final set number of cards in any one of said plurality of suits have been dealt; and settling each players wagers based on predetermined criteria.

2. A method as claimed in claim 1, wherein said predetermined criteria for settling each players wagers comprises the respective location of cards dealt from said set.

3. A method as claimed in claim 1, wherein said predetermined criteria for settling said wagers is based upon the first of said suits to reach said finishing point.

4. A method as claimed in claim 1, wherein said plurality of columns and said plurality of rows together define a plurality of individual cells each adapted for receiving a single card.

5. A method as claimed in claim 1, wherein at least one of said rows defines a decision zone during which said steps of suspending dealing cards and giving each player an option to modify their wager are performed.

6. A method as claimed in claim 1, wherein said gaming surface is provided on a gaming table.

7. A system for operating a wagering game to be played among a plurality of players using a set of playing cards having a plurality of suits with an equal number of cards per suit, the system comprising:

a gaming surface configured to receive at least some of the playing cards thereon;

a game grid on said gaming surface comprising indicia defining a plurality of columns and a plurality of rows, said plurality of columns corresponding to the plurality of suits and said plurality of rows being equal to or less than the number of playing cards per suit, said plurality of columns extending from a starting point to a finishing point for conducting a "race" between said plurality of suits of said playing cards; and at least one decision zone on said gaming surface defined by one of said rows in said game grid between said starting point and said finishing point.

8. A system as claimed in claim 7, further comprising at least one wagering grid on said gaming surface having a plurality of cells corresponding to said plurality of suits.

9. A system as claimed in claim 7, wherein said plurality of columns and said plurality of rows together define a plurality of individual cells each adapted for receiving a single playing card.

10. A system as claimed in claim 7, wherein said gaming surface is on a gaming table.

11. A system as claimed in claim 7, in combination with said set of playing cards.

12. A system of claim 7, wherein the gaming surface is generally semi-circular in shape.

* * * * *